US005777950A

United States Patent [19]

Helm et al.

[11] Patent Number: 5,777,950

[45] Date of Patent: Jul. 7, 1998

[54] METHOD AND APPARATUS FOR TRANSFERRING TIME INFORMATION TO A WATCH

[75] Inventors: Walter Helm, Farmington; Lance Becker, Weston, both of Conn.

[73] Assignee: Timex Corporation, Middlebury, Conn.

[21] Appl. No.: 754,375

[22] Filed: Nov. 21, 1996

[51] Int. Cl.[6] ..... G04C 11/02

[52] U.S. Cl. ..... 368/47; 368/10

[58] Field of Search ..... 368/47, 185, 85, 368/223–242

[56] References Cited

U.S. PATENT DOCUMENTS

| | | | |
|---|---|---|---|
| 2,816,165 | 12/1957 | Benesch et al. | 179/2 |
| 3,881,310 | 5/1975 | Gerum et al. | 58/35 |
| 4,023,344 | 5/1977 | Mukaiyama | 58/35 |
| 4,125,993 | 11/1978 | Emile, Jr. | 58/23 |
| 4,147,022 | 4/1979 | Ichikawa | 368/34 |
| 4,211,065 | 7/1980 | Schmitz et al. | 368/47 |
| 4,534,012 | 8/1985 | Yokozawa | 364/900 |
| 5,488,571 | 1/1996 | Jacobs et al. | 364/705.07 |

*Primary Examiner*—Bernard Roskoski
*Attorney, Agent, or Firm*—Arthur G. Schaier

[57] ABSTRACT

A wristwatch is set by optically transmitting time of day information from a wall clock or table clock to an optical sensor in the wristwatch. The time information is optically transmitted as sequential light pulses by controlling a light source, such as a light emitting diode (LED) in the wall clock or table clock.

5 Claims, 3 Drawing Sheets

METHOD AND APPARATUS FOR TRANSFERRING TIME INFORMATION TO A WATCH

BACKGROUND OF THE INVENTION

This invention relates to electronic timepieces, and more particularly to a method and apparatus for updating and setting the time of day in a portable timepiece, such as a wristwatch, from a stationary timepiece, such as a wall-mounted clock or table clock.

As electronic timepieces have become more complicated, they have become more difficult to set. Also more and more information is contained in the memories of digital timepieces which needs to be updated from time to time. Despite the accuracy of digital timepieces, they must be reset when traveling into new time zones, or after the energy cell has been replaced. Digital timepieces can become difficult or intimidating or tedious to set, especially if the owner's manual has been misplaced.

Systems are known from the prior art for setting the time on one clock from another clock. For example, U.S. Pat. No. 4,023,344 discloses a wristwatch time correction system utilizing a radio receiver for receiving standard time signals such as those broadcast and utilizing the received signal to automatically correct the time of a user's wristwatch placed in a timepiece correction device. U.S. Pat. No. 3,881,310 discloses an arrangement for automatically regulating an electric clock in response to received input radio wave signals. U.S. Pat. No. 2,816,166 discloses a system for synchronizing clocks at a subscriber station by impulses transmitted from a master clock at a telephone central station through a conventional telephone circuit.

More recently, systems have been posed for transmitting data, including time of day information, to a timepiece from a computer. U.S. Pat. No. 4,211,065 Schmitz et al. issued Jul. 8, 1980 shows setting a digital watch through an LED link from a special purpose computer system. U.S. Pat. 5,488,571 - Jacobs et al. issued Jan. 30, 1996 and assigned to the present Assignee discloses a system for transferring data from a CRT video display monitor on a personal computer to a wristwatch by the use of light pulses. U.S. Pat. 4,534,012 discloses a computer time setting of a wristwatch from an LED station attached to a computer.

It would be desirable to provide a simple means for setting or resetting the time of day on a portable timepiece such as a digital wristwatch without the need for special equipment or computers.

It would also be desirable to provide a simplified method for setting a digital wristwatch so as to update several functions without the need for setting them individually using a complex procedure.

SUMMARY OF THE INVENTION

Briefly stated, the invention is practiced by providing a method and apparatus for setting a portable timepiece from a stationary timepiece comprising providing a stationary timepiece having a time base oscillator, at least one stationary timekeeping counter, a light source driver circuit and at least one controllable light source, providing a portable timepiece having an optical sensor, a time base oscillator, at least one portable timekeeping counter, a timekeeping update circuit, and an electro optical time display indicating time of day thereon, sampling the count value of the stationary timekeeping counter,operating the light source driver circuit to cause the controllable light source to serially transmit the sampled count value by turning the controllable light source on and off, positioning the portable timepiece so that the optical sensor faces the controllable light source, receiving the sampled count values from the optical sensor, and applying the count value to the counter update circuit of the portable timepiece to cause the count value in the portable timekeeping counter to correspond to the count value in the stationary timekeeping counter.

DRAWINGS

The invention, both as to organization and method of practice, together with further objects and advantages thereof, will best be understood by reference to the following description, taken in connection with the accompanying drawings, in which:

FIG. 1 is a simplified diagram showing the setting of a portable timepiece from a stationary timepiece, FIG. 2 is a block diagram of a stationary timepiece, FIG. 3 is a top plan view of a prior art digital wristwatch, and FIG. 4 is a block diagram corresponding to the wristwatch of FIG. 3.

DESCRIPTION OF THE PREFERRED EMBODIMENT

Figure 1:
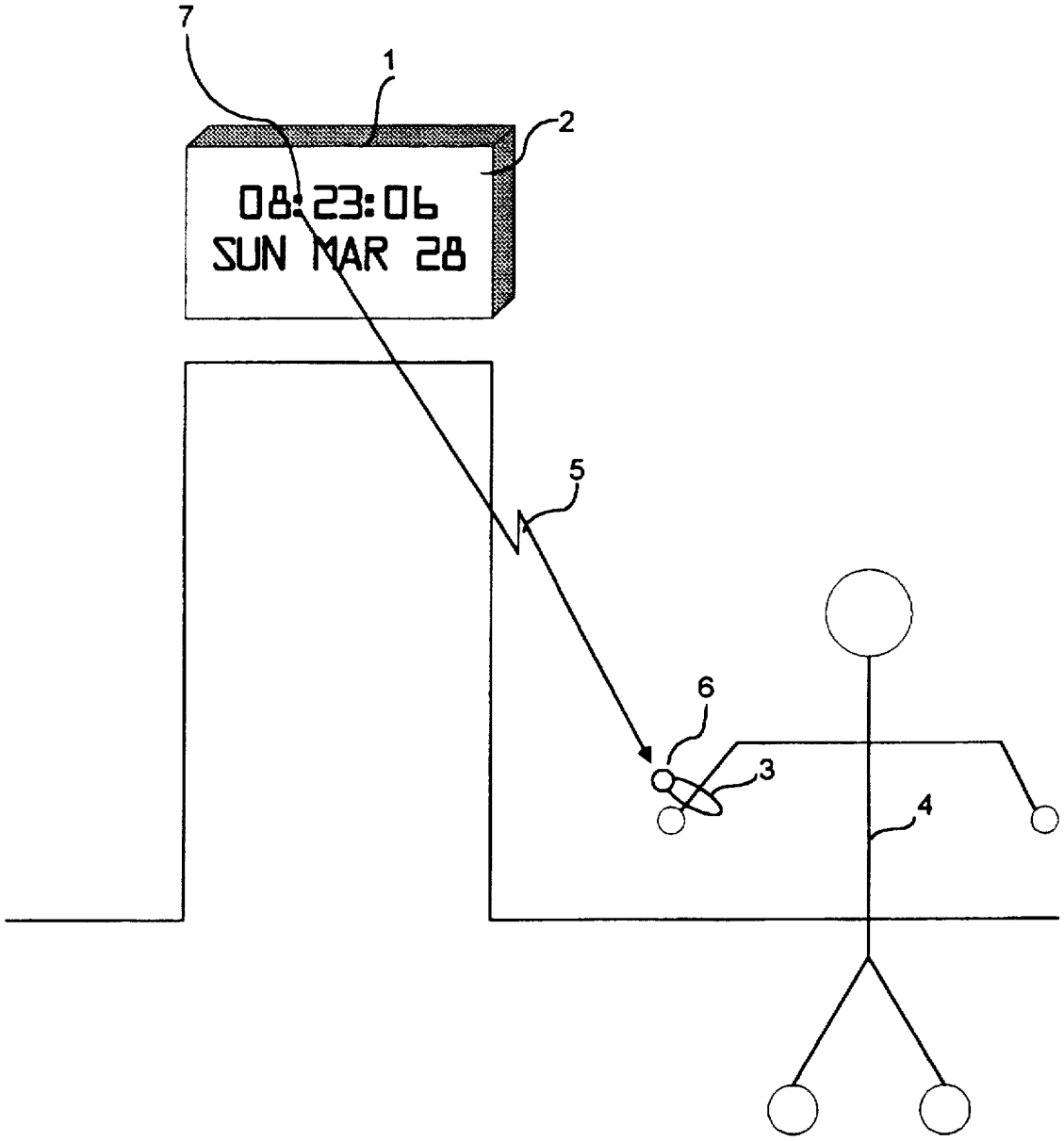

Referring now to FIG. 1 of the drawing, a stationary timepiece is depicted in the form of a wall mounted digital clock 1 displaying the time of day, day of the week and calendar date on a digital display 2 in a manner well known in the art. A digital wristwatch 3, carried on the arm of a user 4 is shown in the process of being set by information in serially transmitted data depicted by the arrow 5 emanating from time display 2. While the time setting information from clock 1 is transmitted continuously, the time of day is only transferred to the digital wristwatch 3 when it is enabled by user 4 by depressing a time-update pushbutton 6.

While the display element which emits the data pulses 5 may be a separate controllable light source disposed in or on display 2, in the case of an LED display, it is also conveniently provided by a pre-existing LED element, such as one of the dots in a flashing colon 7.

Figure 2:
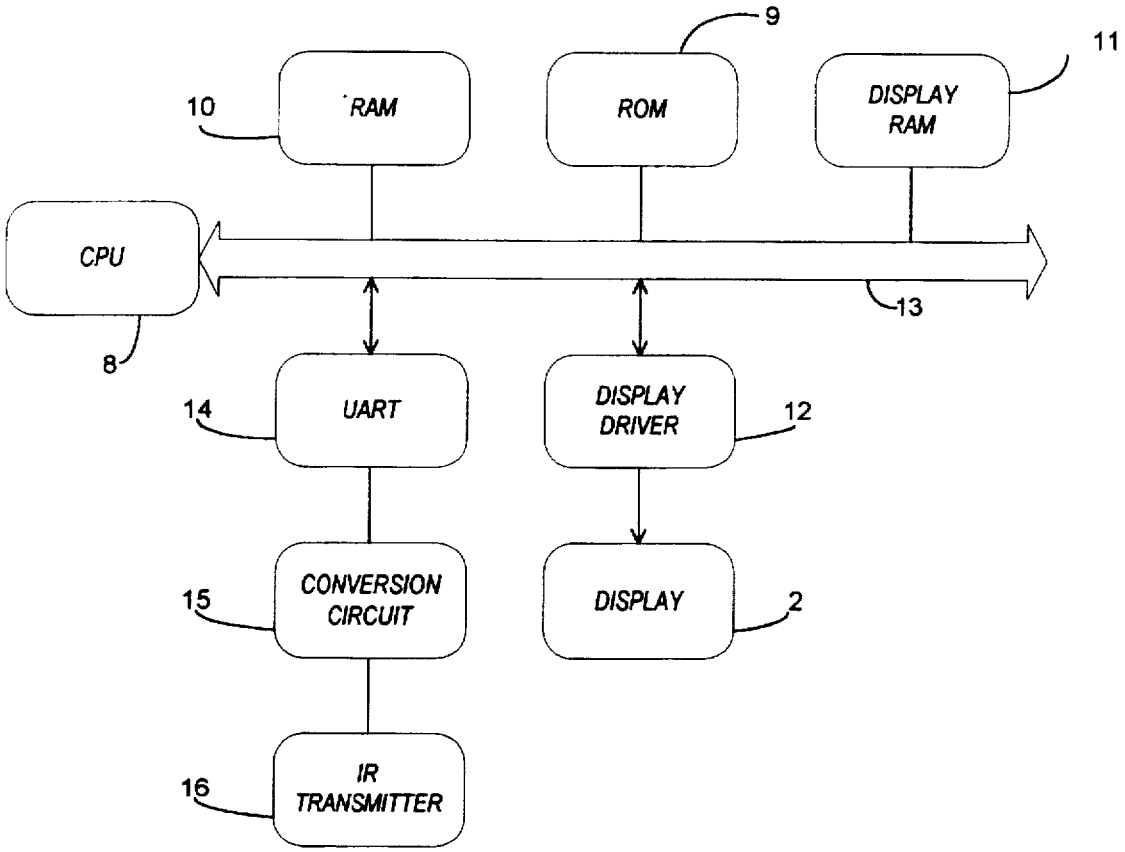
Figure 3:
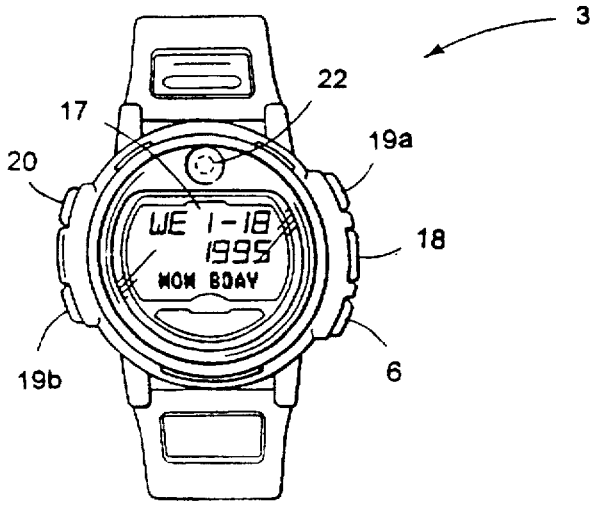
Fig. 3 Prior Art
Figure 4:
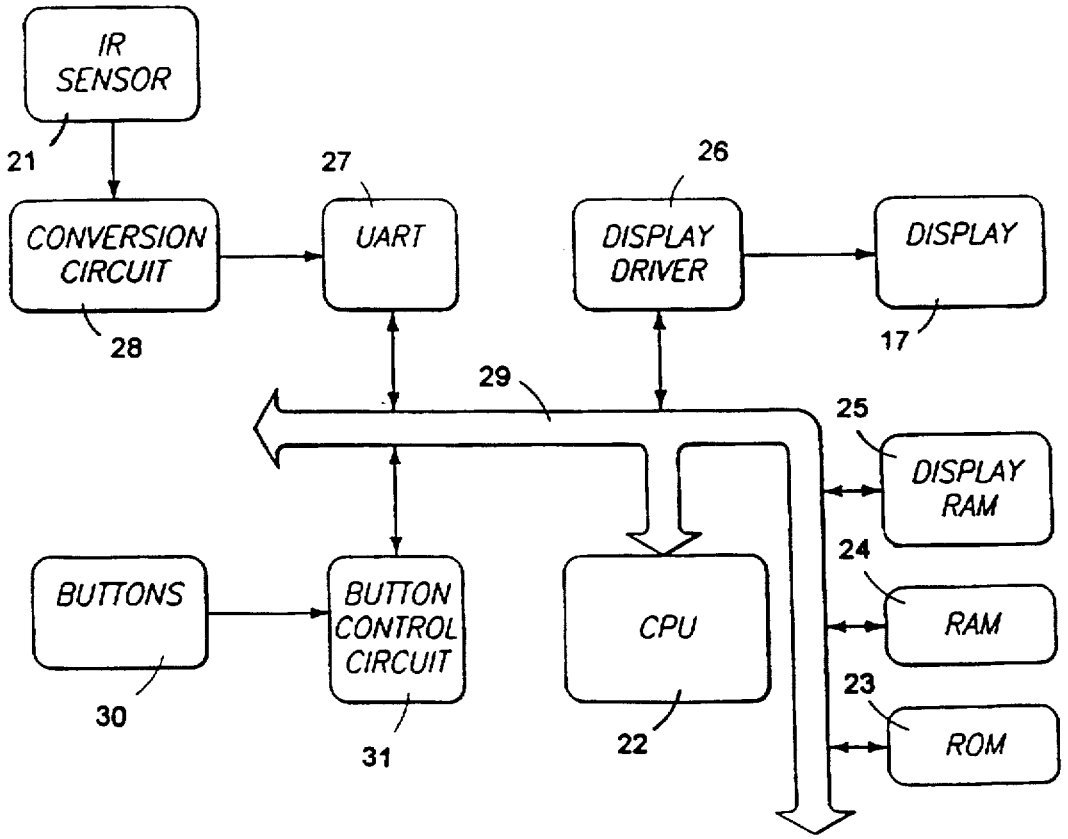
Fig. 4 Prior Art

FIGS. 2, 3 and 4 of the drawing illustrate a preferred embodiment of the invention, in which it is implemented in software by programming a known and commercially available microcomputer embodying a real time clock. The functions performed by the microprocessor in FIG. 2 include a CPU (central processing unit) 8 for performing data processing tasks, a ROM (read only memory) 9 for storing initial power-up programs and the clock operating system, a RAM (random access memory) 10 for data storage, a display RAM 11 to temporarily store display information, a display driver 12 receiving information from an internal bus 13 and driving the display 2 shown in FIG. 1.

A suitable microcomputer for this purpose is available from Motorola Corporation as Model MC146818A, which is a real time clock plus RAM, comprising a complete time of day clock with alarm, one hundred year calendar, a programmable periodic interrupt and square wave generator, and 50 bytes of low power static RAM.

Also receiving time of day information, calendar date and day of the week information stored in RAM 10 is a UART (universal asynchronous receiver and transmitter) 14. An output from UART 14 is connected to a conversion circuit 15 and its output is connected to an IR (infrared) transmitter 16. Conversion circuit 15 and IR transmitter 16 constitute a controllable light source. In one implementation, IR transmitter 16 comprises an LED, seen as element 7 in display 2 in FIG. 1.

The LED in a flashing colon commonly is on during part of a one-second interval. During the time it would normally be illuminated, it can be modulated with the time update information, which will be imperceptible to the human eye.

FIG. 3 shows an external face of programmable watch 3, which is illustrated for discussion purposes as the Timex® Data Link™ watch. Other watch constructions as well as other portable information devices can be used in the context of this invention. Watch 3 includes a small display 17 (such as an LCD), a mode select button 18, next/previous programming buttons 19*a* and 19*b*, and a display light button 20. The previously mentioned time-update button 6 corresponds to the button shown in FIG. 1. An optical sensor 21 is positioned adjacent to display 17. In the programming mode, display 17 indicates the programming option, and what data is being entered therein. During the normal operational mode, display 17 shows time of day, day of week, or any other function common to watches.

Referring now to FIG. 4, watch 3 includes a CPU (Central Processing Unit) 22 for performing data processing tasks, a ROM (Read Only Memory) 23 for storing initial power-up programs and other identification information, and a RAM (Random Access Memory) 24 for data storage. ROM 23 has capacity of approximately 16 Kbytes, while RAM 24 has capacity of 1 Kbyte. A display RAM 25 is provided to temporarily store data used by display driver 26 to depict visual information on display 17. These components can be incorporated into a single microprocessor-based integrated circuit. One appropriate microprocessor IC is available from Motorola Corporation as model MC68HC05HG.

Watch 3 has an optical IR (infrared) sensor 21 which is coupled to a digital serial receiver or UART 27. UART 27 is a conventional, off-the-shelf circuit which receives data in eight-bit words surrounded by start and stop bits. However, UART 27 must receive a conventional NFRZ (non-return to zero) or level-based signal--in contrast to the edge-based signal transmitted by the IR transmitter 16. Therefore, watch 3 includes a filter and conversion circuit 28 to produce a level-based or NRZ serial signal from the edge-based signal generated by IR transmitter 16. Such conversion circuit may include a retriggerable monostable oscillator. The output of filter and conversion circuit 28 is fed to UART 27. UART 27 is coupled to an internal bus 29, which is preferably an eight-bit bus. Inputs received from the control buttons on the watch, referenced generally by box 30, are detected and deciphered by button control circuit 31 and placed on bus 29.

The time setting system provided by the foregoing stationary timepiece depicted in FIG. 2 and the portable timepiece depicted in FIG. 3 and 4 is implemented by suitable programming of the respective devices by operating programs contained in the respective ROM's 9 and 23 in a manner well known to those skilled in the art. In the case of the stationary timepiece depicted in FIG. 2, the timekeeping functions provided by the block diagram require connection of a quartz crystal to the appropriate inputs of the CPU 8 to provide a time base oscillator. The operating program provides a sequential time division of the oscillator frequency until arriving at a 1 Hz time signal. The program subsequently divides the 1 Hz signal by 60 to provide a minutes counter, divides the minutes count by 60 to provide an hours counter, divides the hours count by 24 to provide a days counter, divides the day count by seven to provide a day of the week counter, and divides the days count by 31 to provide a calendar date counter. Memory locations in RAM continuously store the changing count values representing seconds, minutes, hours, day of the week and calendar information in a manner well known in the art. The memory locations storing these values are designating timekeeping counters and store the information in binary form.

The program for the stationary timepiece provides that CPU 8 periodically samples the count values contained in the memory locations of RAM 10, whereupon they are placed on data bus 13, converted from parallel input to serial output in UART 14, formatted as suitable bytes of timekeeping data in the form of serial data bits in conversion circuit 15, and transmitted as sequential light pulses by IR transmitter 16.

The portable timepiece shown in FIG. 4 contains a program in ROM 23 controlling the operation of the timepiece as already explained in U.S. Pat. No. 5,488,571, which is incorporated herein by reference. The program is also arranged to update the time of day information represented by count values in the timekeeping counters contained in RAM 24 when button 6 is depressed. The light pulses received on IR sensor 21 are converted from edge-based signals to level-based signals in conversion circuit 28, converted from serial to parallel format in UART 27 and placed on data bus 29. CPU 22 is programmed to write the new timekeeping data count values into the appropriate memory locations of RAM 24, thereby updating the timekeeping data which is displayed on watch display 17.

OPERATION

The stationary timepiece emits time of day, date and calendar information. It may either emit the information continuously as in the example shown for a wall-mounted clock, or it may emit the information on demand. For example, a table clock may be activated to emit the time information on demand by pressing a button on the clock. When a user wishes to set the timepiece, it is positioned so that the optical sensor faces the IR transmitter or controllable light source, and depresses button 6. When this occurs, the serial data containing the count values contained in the timekeeping counters of the stationary timepiece are received by the IR sensor of the watch and substituted in the watch RAM for the timekeeping count values which were there previously, thereby updating the timekeeping count values and thereby setting the digital wristwatch. This is particularly useful when entering a new time zone, allowing ease for resetting the traveler's watch from a clock at the gate in an airport or rail terminal.

While the stationary timepiece in FIG. 1 is depicted as a wall-mounted digital timepiece, it may also be a table clock. While the clock 1 depicted in FIG. 1 is illustrated as an LED digital clock, it could be an LCD clock with any type of controllable or controllable light source serving to transmit the timekeeping data. Preferably the controllable light source is an LED, because of its simplicity and speed of transmission. However other controllable light sources such as electroluminescent lamps, incandescent lamps, etc. may be suitable if lower data transmission speeds can be tolerated.

While there has been described what is considered to be the preferred embodiment of the invention, other modifications will occur to those skilled in the art, and it is desired to secure in the appended claims all such modifications as fall within the true spirit and scope of the invention.

We claim:

1. Method for setting a portable timepiece from a stationary timepiece, comprising:

providing a stationary timepiece having a time base oscillator, a stationary minutes counter,a stationary hours counter, a light source driver circuit and a stationary time display incorporating therein at least one controllable light source, providing a portable timepiece having an optical sensor, a time base oscillator,a portable minutes counter, a portable hours counter, a minutes update circuit, an hours update circuit, and a portable electro optical time display indicating at least hours and minutes thereon, sampling the count values of the stationary minutes counter and the stationary hours counter, operating the light source driver circuit to cause the controllable light source to serially transmit the sampled count values by turning the controllable light source on and off, positioning the portable timepiece so that the optical sensor faces the controllable light source, receiving the sampled count values from the optical sensor, and applying the count values to the minutes update circuit and the hours update circuit of the portable timepiece to cause the count values in the portable minutes counter and the portable hours counter to correspond to the count values in the stationary minutes counter and the stationary hours counter.

2. The method according to claim 1 wherein the controllable light source is an LED.

3. Apparatus for continuously providing time update information to a portable timepiece, comprising:

a stationary timepiece having a time base oscillator, at least one timekeeping counter, a light source driver, at least one controllable light source, and a time display indicating the time in the timekeeping counter and incorporating the controllable light source therein, means for sampling the count value of the timekeeping counter, means for operating the light source driver circuit to cause the controllable light source to serially transmit the sampled data by turning the controllable light source off and on, whereby the time displayed on the timepiece and stored in the timekeeping counter is also transmitted in the form of light pulses.

4. The combination according to claim 3, wherein the time display is an LED display.

5. The combination according to claim 4, wherein the controllable light source is an LED element in the LED display.

* * * * *